US007735615B2

(12) United States Patent
Looram et al.

(10) Patent No.: US 7,735,615 B2
(45) Date of Patent: Jun. 15, 2010

(54) SOFT LUGGAGE HAVING AN INTERNAL BARRIER

(75) Inventors: Mark Looram, San Francisco, CA (US); Sean Looram, San Francisco, CA (US)

(73) Assignee: General Trading Organisation Limited, Kwon Tong (HK)

( * ) Notice: Subject to any disclaimer, the term of this patent is extended or adjusted under 35 U.S.C. 154(b) by 166 days.

(21) Appl. No.: 11/679,165

(22) Filed: Feb. 26, 2007

(65) Prior Publication Data

US 2008/0202878 A1 Aug. 28, 2008

(51) Int. Cl.
*A45C 13/10* (2006.01)
*A45C 13/18* (2006.01)
*A45C 3/00* (2006.01)

(52) U.S. Cl. ..... 190/101; 190/28; 190/120; 190/903; 150/118; 383/97

(58) Field of Classification Search ..... 190/101, 190/119, 120, 124, 126, 902, 903, 28; 383/97; 24/381.432; 150/118
See application file for complete search history.

(56) References Cited

U.S. PATENT DOCUMENTS 1,314,399 A 12/1919 Hicks
1,557,382 A * 10/1925 Sundback ..... 24/387
1,859,970 A * 5/1932 Kaufmann ..... 190/119
1,930,659 A * 10/1933 Purdy ..... 55/369
2,112,795 A * 3/1938 Strayer ..... 70/68
2,166,885 A * 7/1939 Wiseman ..... 24/389
2,249,841 A * 7/1941 Loos et al. ..... 190/119
2,252,783 A * 8/1941 Potts et al. ..... 402/70
2,264,085 A * 11/1941 Loos ..... 190/119
2,335,950 A * 12/1943 Lynam ..... 190/119
2,341,814 A * 2/1944 Ritter, Jr. ..... 292/284
2,373,573 A * 4/1945 Langford et al. ..... 190/115
2,495,391 A * 1/1950 Smith ..... 206/320
2,515,715 A 7/1950 Jones
2,648,412 A * 8/1953 Meyers ..... 190/119
2,962,070 A * 11/1960 Towles ..... 383/59
3,088,623 A 5/1963 Parker
3,477,553 A * 11/1969 Kish, Jr. ..... 190/119
3,730,309 A 5/1973 Hamann et al.
4,066,195 A 1/1978 Dickler
4,127,155 A 11/1978 Hydorn
4,628,545 A * 12/1986 Metzler ..... 2/265
4,733,549 A 3/1988 Baker
4,817,769 A 4/1989 Saliba
4,838,709 A * 6/1989 Guerriero et al. ..... 383/18
5,168,968 A 12/1992 Fritze
5,181,299 A * 1/1993 Huang ..... 24/432
5,451,282 A 9/1995 Fore
6,068,113 A 5/2000 Schmaling et al.
6,079,528 A * 6/2000 Moor ..... 190/126
6,431,334 B1 8/2002 Lin (Continued)

*Primary Examiner*—Sue A Weaver
(74) *Attorney, Agent, or Firm*—Baumgartner Patent Law

(57) ABSTRACT

Soft-sided luggage having means for preventing unauthorized access through the zipper is disclosed herein. Preferred means for preventing unauthorized access through the zipper include a rigid barrier attached internally to a first side of the luggage, positioned alongside and extending to the length of the zipper track, and extending past the plane of the zipper towards the second side of the luggage. Further security features can also be used with soft luggage provided herein, including padlocks, and flaps crossing the zipper plane, for example.

15 Claims, 4 Drawing Sheets

U.S. PATENT DOCUMENTS

| | | | | |
|---|---|---|---|---|
| 6,502,677 | B1 | 1/2003 | Tiramani et al. | |
| 6,929,125 | B1 | 8/2005 | Seamans | |
| 2004/0035661 | A1 | 2/2004 | Krulik et al. | |
| 2005/0194227 | A1 | 9/2005 | Ethan et al. | |
| 2005/0205459 | A1 | 9/2005 | Mogil et al. | |
| 2006/0010660 | A1 * | 1/2006 | Stenhall | 24/389 |

* cited by examiner

SOFT LUGGAGE HAVING AN INTERNAL BARRIER

FIELD OF THE INVENTION

The invention described herein generally relates to soft-sided luggage having an internal rigid barrier to prevent unauthorized access through the zipper.

BACKGROUND

Security for luggage is an important issue for travelers. Every day, many people have their belongings stolen from inside their hard case or soft-sided luggage. In, contrast to soft-sided luggage, hard cases are not as vulnerable to theft as both the lid and the compartment are rigid shells, buckled together and locked with a combination lock or padlock. It is thus very difficult to separate the hard case lid from the main compartment. While considered more secure, hard cases are not a popular choice among travelers because they are typically heavy and not easily manipulated to fit within confined spaces such as overhead bins or automobile trunks.

In contrast, soft-sided luggage is typically much lighter and pliable for easier travel and storage. Soft-sided luggage predominately utilizes a zipper that traverses the outer perimeter and thus allows easy access to the internal compartment, whether authorized or not. A common way of preventing unauthorized access into the internal contents of soft-sided luggage is to lock the zipper's two pull-tabs together with a padlock. While a padlock locking the two pull-tabs together prevents the unauthorized unzipping of the zipper, it fails to prevent a breach along the zipper chain. A closed zipper chain can readily be breached by simply jabbing it with one of many common items such as a pencil, pen, knife, fork, or screwdriver, regardless of whether the pull tabs are locked or not.

After an opening is created along the zipper chain, the remaining closed chain can be easily separated by manually pulling the zipper teeth apart and exposing the internal contents. The unauthorized person would then have complete access to either steal the contents of the luggage or place dangerous materials inside, including chemical, radioactive, or biological agents, and explosives. After accessing the internal compartment, the intruder could then slide the zipper pull tabs, whether locked together or not, along the chain, thus zipping the opening closed so the intrusion is difficult to detect.

Until now, the above-described susceptibility of zippers has not been adequately addressed, much less a viable solution. Accordingly, one object of the teachings herein is to provide improvements to zippered, soft-sided luggage that prevent unauthorized access into the internal contents, yet still retain the popular properties of soft-sided luggage, including lightweight and pliability.

SUMMARY OF THE INVENTION

In preferred embodiments, the teachings herein are directed to soft-sided luggage comprising a compartment having side walls surrounding a bottom panel and defining an open cavity; a first zipper track attached to a plurality of said compartment side walls; a lid having side walls surrounding a top panel, wherein said lid is configured to fit on said compartment such that said cavity is closed; a second zipper track attached to a plurality of said lid side walls and configured to releasably interlock with the first zipper track; and a first rigid barrier internally attached to the lid, positioned alongside and extending to at least the substantial length of the second zipper track, and configured such that it extends into the main compartment, past the first zipper track, when said lid is closed on said compartment.

In further preferred embodiments, the soft-sided luggage described herein can include a plurality of pull tabs positioned on said first and second zipper tracks and configured to be locked by a padlock.

In further advantageous embodiments the soft-sided luggage herein can include a flap externally attached to said lid and configured to extend across the first zipper track and securely couple to said compartment through a coupling member, when the lid is zipped to the compartment. In more specific embodiments, the coupling member is a staple externally attached to said compartment and configured to fit through an aperture on said flap. In even more specific embodiments, a padlock can be shackled through the staple such that the flap is locked to the main compartment.

In additional preferred embodiments, the soft-sided luggage provided herein can include a second rigid barrier internally attached to the compartment, positioned alongside and extending to at least the substantial length of the first zipper track, and configured such that it extends into the lid, past the second zipper track, when said lid is closed on said compartment.

In further embodiments, the teachings herein are directed to soft-sided luggage including a compartment having side walls surrounding a bottom panel and defining an open cavity; a first zipper track attached to a plurality of said compartment side walls; a lid having side walls surrounding a top panel, wherein said lid is configured to fit on said compartment such that said cavity is closed; a second zipper track attached to a plurality of said lid side walls and configured to releasably interlock with the first zipper track; and a first rigid barrier internally attached to the compartment, positioned alongside and extending to at least the substantial length of the first zipper track, and configured such that it extends into the lid, past the second zipper track, when said lid is closed on said compartment.

In still further preferred embodiments, the teachings herein are directed to bags having first and second sides defining a compartment; a first zipper track attached to said first side; a second zipper track attached to said second side and configured to releasably interlock with the first zipper track such that both said first and second sides close said compartment; and a first rigid barrier internally attached to the first side of the compartment, positioned alongside and extending to at least the substantial length of the first zipper track, and configured such that it extends across said second zipper track into the second side of the compartment, when the first and second sides are zipped together.

In still further embodiments the bags provided herein can include a plurality of pull tabs positioned on said first and second zipper tracks and configured to be locked by a padlock. In still further embodiments, the bags provided herein can include a flap externally attached to the first side and configured to extend across the second zipper track and securely couple to said second side, through an external coupling member, when the first and second sides are zipped together.

In still further embodiments, the bags described herein can include a second rigid barrier internally attached to the second side, positioned alongside and extending to at least the substantial length of the second zipper track, and configured such that it extends into the first side, past the second zipper track, when said first and second sides are zipped together.

BRIEF DESCRIPTION OF THE DRAWINGS

It will be appreciated that the drawings are not necessarily to scale, with emphasis instead being placed on illustrating the various aspects and features of the invention, in which.

DETAILED DESCRIPTION OF THE ILLUSTRATED EMBODIMENTS

Embodiments of the present invention are described below. It is, however, expressly noted that the present invention is not limited to these embodiments, but rather the intention is that modifications that are apparent to the person skilled in the art and equivalents thereof are also included.

In general, the teachings herein are directed to preventing unauthorized access into soft case luggage. The terms "soft case luggage," "soft luggage" or "soft-sided luggage" are used interchangeably herein and relate to luggage that does not have a predominantly rigid shell, whether externally or internally. More specifically, the term "soft-sided luggage" does not include containers having surface areas that are predominantly made of wood, metal, or fiberglass. Nor does the term "soft-sided luggage" relate to containers that have an internal or external shell such that the surface area is made entirely, or predominantly of rigid plastic, such as sealed containers for insulation, waterproofing, or to create an air-tight environment. Examples of these types of hard cases are disclosed in U.S. Pat. No. 6,929,125 to Seamans, U.S. Pat. No. 6,068,113 to Schmaling et al., which are hereby incorporated by reference in their entireties.

The teachings herein can work with any suitable soft-sided luggage, expressly, yet non-exclusively, including suitcases, briefcases, satchels, backpacks, duffel bags, and the like. According to certain embodiments, the soft case luggage described herein can non-exclusively include one or more of the following features: rigid handles, rigid wheels, rigid hollow housing for retractable or telescoping handles, rigid inserts for mounting wheel or handles, and thin framing for minor structural support. The barriers provided herein can be used with the soft luggage described in U.S. Pat. No. 5,833,039 to Kotkins, Jr., for example, which is expressly incorporated herein by reference in its entirety.

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention.

Figure 1:
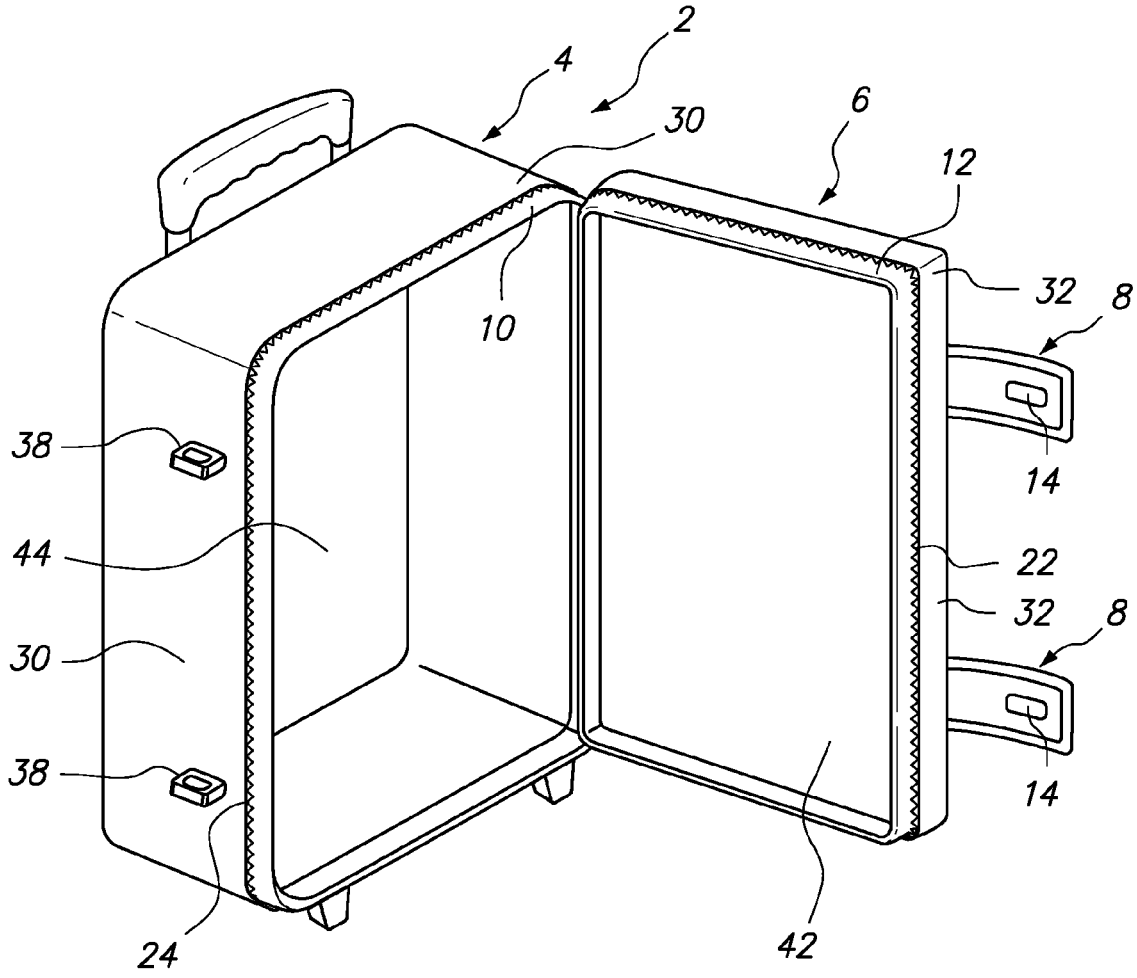
FIG. 1 is a perspective view depicting preferred soft-sided luggage, unzipped and open.

FIG. 1. depicts a preferred embodiment of soft-sided luggage 2 having a lid 6 hinged to a main compartment 4. Preferably, the main compartment 4 includes four sides 30, attached to and surrounding a bottom panel 44 that together define a main cavity. Preferably, one of the four sides of the main compartment 30 includes a hinged connection to one side of the lid 6. The lid 6 preferably includes four sides 32 surrounding a top panel 42. The sides 32 of the lid 6 can be configured to any suitable dimensions. For example, in certain embodiments, the side walls 32 will essentially be an outer periphery, while in other embodiments the sides of the lid can extend downward, away from the top panel 42, to define another cavity.

Figure 2:
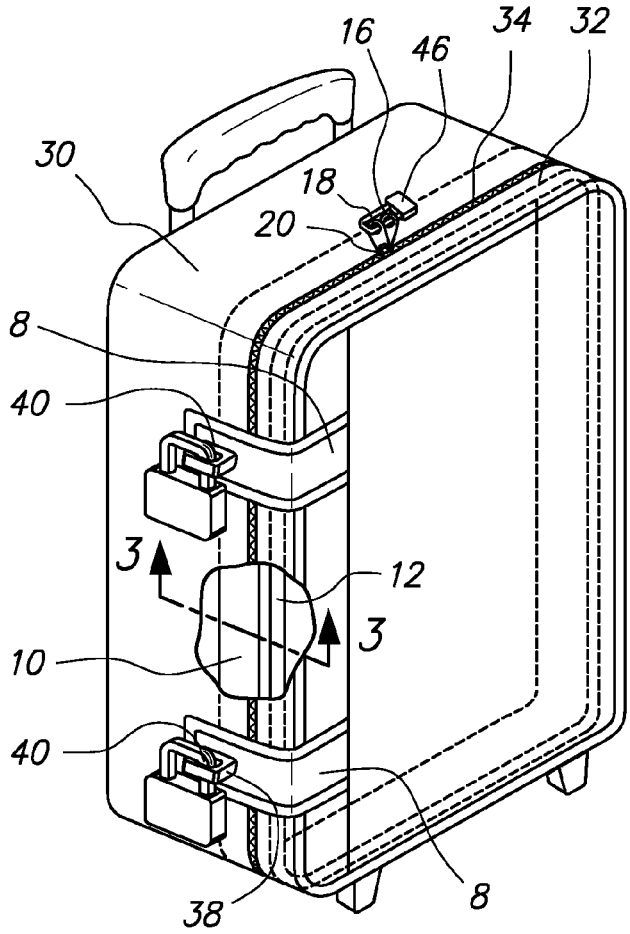
FIG. 2 is a perspective view depicting preferred soft-sided luggage, zipped and locked.

While a suitcase is depicted in FIGS. 1 and 2, further embodiments utilizing other types of soft-sided luggage are expressly contemplated herein. For example, in advantageous embodiments utilizing a backpack, the sides of the main compartment can be more pliable and undefined, and extend inward, toward the center of the cavity, for example. In additional embodiments, such as when a backpack is utilized, the top panel of the lid does not need necessarily conform (e.g., can be smaller) to the size of the back panel of the main compartment, as depicted in FIGS. 1 and 2.

While preferred embodiments described herein are directed to luggage having a main compartment and a lid, these embodiments are expressly non-limiting. More specifically, the barriers provided herein can also be used in conjunction with side compartments, or other compartments smaller than the main compartment, for example. Furthermore, while "main compartment" and "lid" are used predominantly herein for convenience, it is expressly contemplated that the "lid" and "main compartment" can potentially have similar or equivalent sized cavities, in certain embodiments.

To allow access to the cavity of the main compartment 4, it is preferred that a plurality of sides on the main compartment 4 and the lid 6 include a zipper track (24 and 22) for releasably attaching the non-hinged sides of the lid 6, thereby creating a closed compartment. In other embodiments, not depicted in the figures, the lid can be completely removable, such that each side of the lid is configured to be releasably zipped to the sides of the main compartment.

In even more preferred embodiments, the lid 6 includes a first track of zipper teeth 22 attached around the sides 32 and configured to complementary engage with a second track of zipper teeth 24 along the sides 30 of the main compartment 4. Preferably, the tracks of zipper teeth 22 and 24 are attached through the use of zipper tape, sewn or heat-sealed to the lid 6 and main compartment 4 respectively, but any suitable means for attaching the tracks of the zipper teeth (22 and 24) to the luggage 2 are contemplated herein.

The barriers provided herein can be used with any suitable soft-sided luggage utilizing a zipper. Typically a zipper includes one or two sliders 20 configured to travel along complementary and separated zipper teeth tracks (22 and 24) to create a closed zipper chain 34. Conversely, when the slider 20 travels in the opposite direction, it separates the complementary zipper tracks (22 and 24) thereby opening the chain 34.

In preferred embodiments, the slider 20 is attached to one or more pull-tabs 16 configured to allow a user to manipulate the slider 20 along the tracks (22 and 24), and closed chain 34. In still further embodiments, the pull-tab 16 is configured to be locked to the pull-tab of another slider or other section of the luggage in order to prevent an unauthorized user from unzipping the chain 34. In preferred embodiments, the pull-tab 16 includes an aperture 18 configured to allow passage of a padlock's 46 shackle to lock the pull-tab 16 to a second pull-tab or other section of the luggage. In addition to teethed tracks or "tooth style" zippers described above, the barriers provided herein can also be readily used with zippers utilizing coiled tracks.

In preferred embodiments the lid 6 includes a first rigid barrier 12 forming an inner perimeter and extending away from the top panel 42. In more specific embodiments, the barrier 12 is internally adjacent to, or otherwise in close proximity, to the zipper track 22. In even more specific embodiments, the barrier 12 can be positioned alongside and extending to the length of the first zipper track 22. The rigid barrier 12 can be attached to either one or more sides 32 of the lid 6 or the top panel 42, by any suitable means, non-exclusively including welding, gluing, sewing, or through a connecting member, for example.

Figure 3:
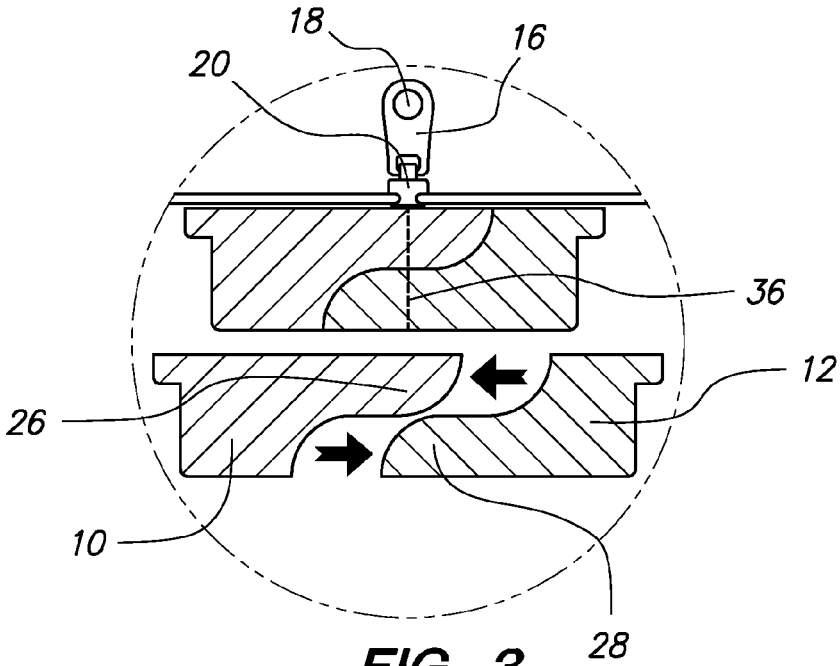
FIG. 3 is a close-up view depicting an embodiment where abutting internal barriers interact to block access into the luggage through the zipper chain.

In further preferred embodiments, and as depicted in FIG. 3, the first rigid barrier 12 is configured to extend towards the back panel 44 of the main compartment 4, past the plane 36 of the zipper chain 34 when the lid 6 is closed onto the main compartment 4.

According to preferred embodiments, the main compartment 4 can include a second rigid barrier 10 forming an inner perimeter and extending away from the bottom panel 44. In more specific embodiments, the barrier 10 is internally adjacent to, or otherwise in close proximity, to the first zipper track 24. In even more specific embodiments, the barrier 10 can be positioned alongside and extending to the length of the first zipper track 24. The rigid barrier 12 can be attached to either one or more sides 30 of the compartment 4 or the bottom panel 44, by any suitable means, non-exclusively including welding, gluing, sewing, or through a connecting member, for example.

In further preferred embodiments, and as depicted in FIG. 3, the second rigid barrier 10 is configured to extend towards the top panel 42 of the lid 6, past the plane 36 of the zipper chain 34 when the lid 6 is closed onto the main compartment 4.

Figure 4:
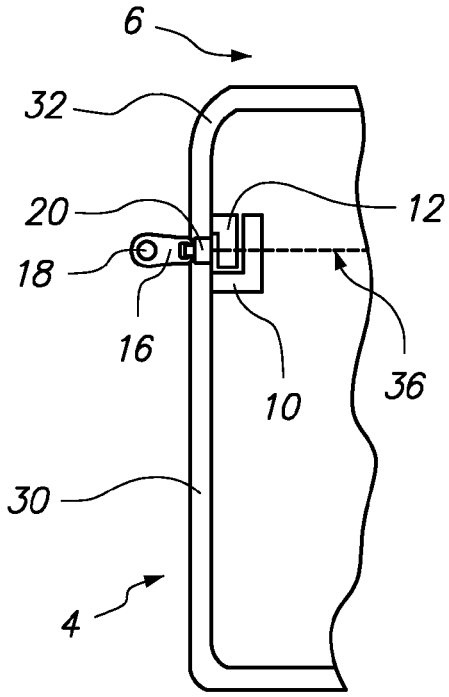
FIG. 4 is a close-up view depicting an embodiment where internal barriers block access into the luggage through the zipper chain.

In more specific embodiments, and as depicted in FIG. 3, the ends (26 and 28) of the first and second rigid barriers 12 and 10 can be configured to overlap and abut against one another, effectively creating a double barrier. In other embodiments, and as depicted in FIG. 4, the first and second rigid barriers 12 and 10 can overlap without abutting against each other.

The barriers provided herein can be configured in any suitable position to block access through the zipper. In certain embodiments, the barriers provided herein can extend downward from their attached side past the zipper chain. In other embodiments, the barriers can be more L-shaped, such that they extend inward (towards the cavity and away from the attached side) then past the zipper chain.

Figure 5:
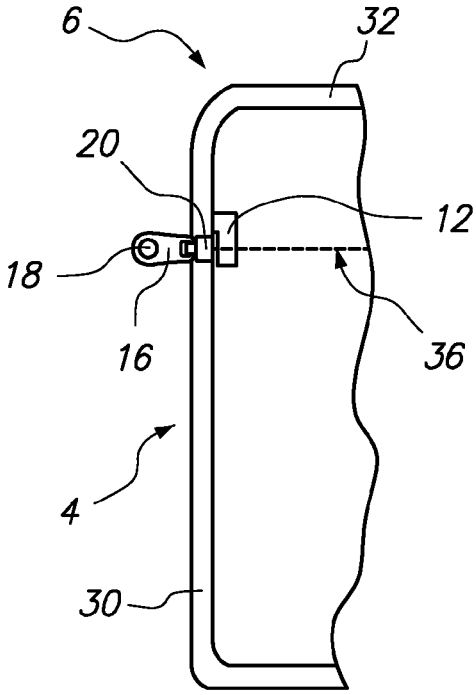
FIG. 5 is a close-up view depicting an embodiment where an internal barrier blocks access into the luggage through the zipper chain.

While FIGS. 1-4 and 6, depict luggage having two rigid barriers, it is expressly contemplated that the soft-sided luggage described herein can be used with only 1 rigid barrier 10 or 12, whether attached to the main compartment 4 or the lid 6. FIG. 5, for example, depicts a non-exclusive embodiment utilizing a single barrier 12. More, specifically, and according to preferred embodiments, the single rigid barrier 12 is configured to extend towards the back panel 44 of the main compartment 4, past the plane 36 of the zipper chain 34 when the lid 6 is closed onto the main compartment 4. Conversely, the main compartment can include a single rigid barrier 10 that is configured to extend towards the top panel 42 of the lid 6, past the plane 36 of the zipper chain 34 when the lid 6 is closed onto the main compartment 4.

According to certain non-exclusive embodiments, the first or second rigid barriers (12 or 10) extend less than about 4, 3, 2.5, 2, 1.5, and 1 inch past the plane 36 of the zipper chain 34 towards the back panel 44 or top panel 42, respectively. According to more specific embodiments, it is preferred that the first barrier 12 does not extend to reach the back panel 44, nor does the second barrier 10 extend to reach the top panel 42. In other preferred non-exclusive embodiments, the rigid barrier is approximately less than 1.5, 1.25, 1, 0.75, 0.5, 0.25 inches thick. In still further embodiments, the barrier is a solid material without easily detectable apertures. In further embodiments, the barrier may contain small apertures throughout.

According to advantageous embodiments, the rigid barriers provided herein are preferably made of high-grade injection molded plastic such that it is both light and rigid. Other suitable rigid materials can also be used as barriers with the teachings herein.

Figure 6:
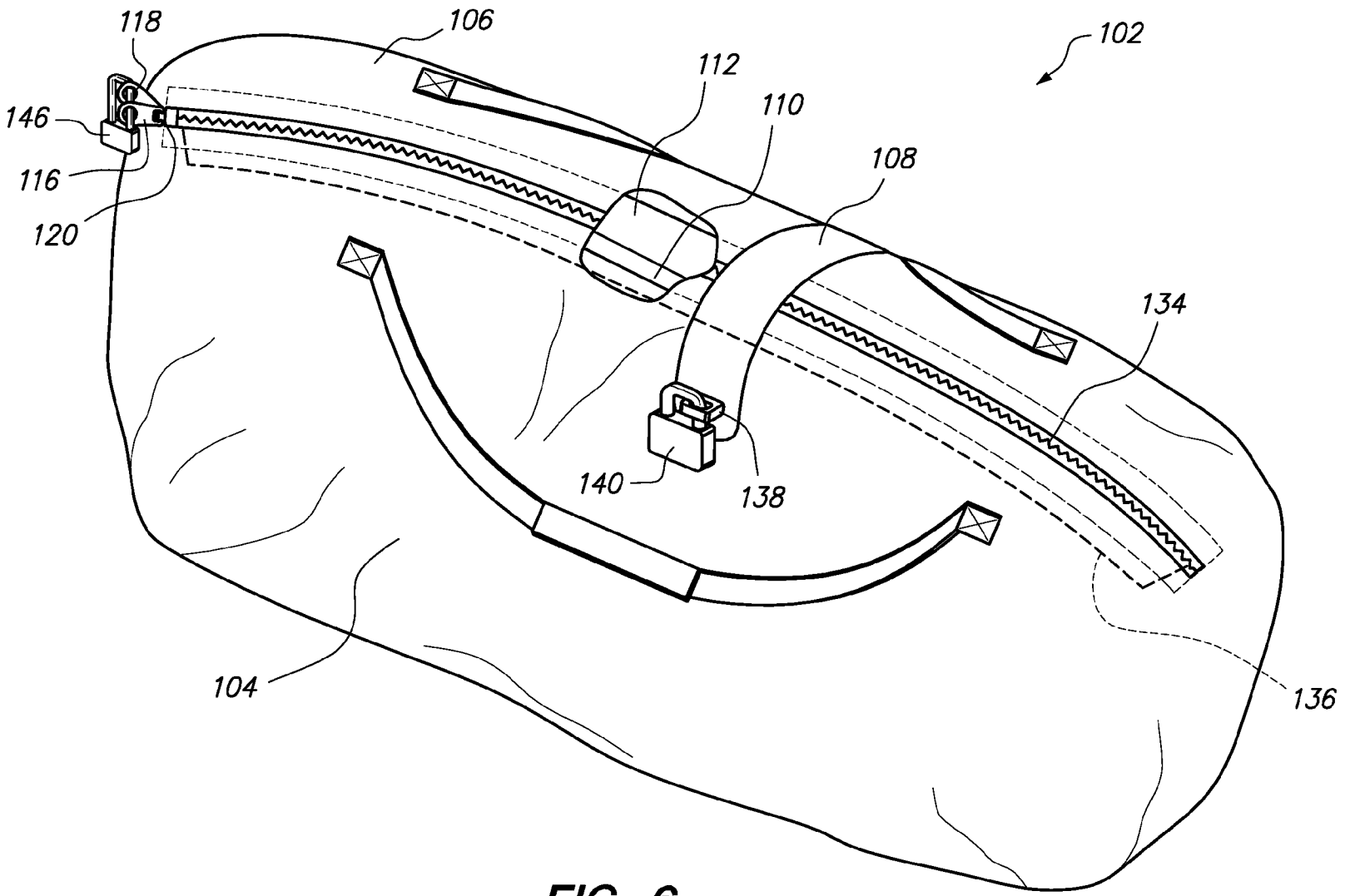
FIG. 6 is a perspective view depicting a duffel bag having two internal barriers blocking access through the zipper chain.

While depicted in FIGS. 1 and 2 as traversing a rectangular or square perimeter, other shapes of barriers can be used, depending on the particular shaped perimeter of the luggage. Non-exclusive shapes of the barrier can include oval, circular, triangular, or other suitable polygons, and the like, for example. In examples where the barrier is being used in conjunction with a duffel bag, such as depicted in FIG. 6, it is preferred to use 1 or more linear barriers (112 and 110) traversing alongside the zipper chain 134, to block access into the compartment.

According to preferred embodiments, the 1 or more barriers (10 and 12) are positioned around the entire, or substantially the entire length, of the zipper chain 34 to block access therein. In still further non-exclusive embodiments, the barriers (10 and 12) do not necessarily need to extend around the entire perimeter of the main compartment or lid. For example, the 1 or more barriers can readily be positioned along the majority of the side walls (32 and 30). In still further embodiments, the 1 or more barriers (10 and 12) traverse around approximately 3 to 3.5 side walls (32 and 30) of the luggage 2. For example, according to certain embodiments, the barrier 10 does not necessarily need to extend around the side of the lid 6 hinged to the main compartment 4, as there is no zipper access in that location. In still further embodiments, the 1 or more barriers (10 or 12) extend around all, or substantially all, 4 side walls 32 and 30 of the luggage 2 including any hinged (non-zippered) sides.

In addition to utilizing a rigid barrier, the soft-sided luggage provided herein can also include additional security features, including 1 or more padlocks 46 to lock zipper tabs 16 together. In more preferred embodiments, the luggage 2 can include 1 or more flaps 8 (e.g., 2, 3, 4, 5 for example) configured to prevent an unauthorized person from unzipping the zipper chain 34. More specifically, and according to preferred embodiments, a flap 8 attached to the lid 6 can include a hole 14 configured to slide over a staple 38 attached to an exterior side 30 of the main compartment 4. In preferred embodiments, the staple 38 is a U-shaped structure, made of a rigid material, such as metal or plastic, securely attached to the exterior side 30 of the main compartment by any suitable means. According to advantageous embodiments, once the flap's 8 hole 14 is slid over the staple 38, the shackle of a padlock 40 can be slid through the staple 38 thereby securing the flap 8, and thus the lid 6, to the main compartment 4. It is also expressly contemplated to reverse the configuration of flap and staple, such that the flap is attached to the body of the main compartment, and configured to work in cooperation with a staple on the lid. Further means for releasably securing the flap across the zipper chain 34 are also expressly contemplated herein.

The flaps 8 are an advantageous feature to be used in conjunction with the 1 or more rigid barriers provided herein to prevent unauthorized access into the luggage 2. More specifically, should an unauthorized breach occur along the zipper chain 34, the locked flaps 8 can prevent the interloper from further prying the lid 6 away from the main compartment 4, while the 1 or more rigid barriers can prevent the interloper from reaching into the luggage 2.

FIG. 6 shows a preferred duffel bag 102 that can be used in conjunction with the barriers described herein. With reference to FIG. 6, the duffel bag includes to a first and second side 106 and 104 separated by a zipper chain 134 traversing across the topside of the bag 102.

The term "sides" is used with embodiments directed to luggage bags for convenience, not to suggest defined, or rigid walls. More specifically, the term "sides" as used with these embodiments relates to pliable sections of a bag, separated from one another by a zipper.

In preferred embodiments, the duffel bag can include 1 or more zipper pull tabs 116 attached to a slider 120. In preferred embodiments, the 1 or more pull tabs 116 include a hole 118 or are otherwise configured to be locked to either each other or a part of the duffel bag 102. In preferred embodiments the 1 or more holes 118 are configured such that a shackle of a small padlock 146 can fit through.

With continued reference to FIG. 6, a first barrier 112 can be attached to the first side 106 of the duffel bag and extend past the plane of the zipper track 134 towards the second side 104 of the duffel bag. According to advantageous embodiments, the duffel bag can contain a first barrier 112 by itself or an additional second barrier 110 attached to the second side 104 of the duffel bag that extends past the plane of the zipper track 134 towards the first side 106. According to certain embodiments, the first or second rigid barriers (112 or 110) extend less than about 4, 3, 2.5, 2, 1.5, and 1 inch past the plane 136 of the zipper chain 134 towards the second side 104 or the first side 106, respectively.

The above description of barriers used in conjunction with soft-sided luggage having a main compartment 4 and a lid 6, including positioning, configuration, materials, construction, and dimensions is readily applicable to luggage bag embodiments, to the degree not inconsistent with. Similarly, the duffel bags provided herein can also include 1 or more flap 108, staple 138, and lock 140 interactions, as discussed above, to prevent an unauthorized person from separating the first side 106 from the second side 104. Further means for releasably securing the flap 108 across the zipper chain 134 are also expressly contemplated herein.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

What is claimed is:

1. Soft-sided luggage comprising:

a compartment having pliable side walls surrounding a bottom panel and defining an open cavity;

a first zipper track attached to a plurality of said compartment side walls;

a lid having pliable side walls surrounding a top panel, wherein said lid is configured to fit on said compartment such that said cavity is closed;

a second zipper track attached to a plurality of said lid side walls and configured to releasably interlock with the first zipper track;

a first rigid barrier internally attached to the lid's pliable side walls, positioned alongside and extending to at least the substantial length of the second zipper track, and configured such that it extends into the compartment, past the first zipper track, when said lid is closed on said compartment.

2. The soft-sided luggage of claim 1, further comprising a plurality of pull tabs positioned on said first and second zipper tracks and configured to be locked by a padlock.

3. The soft-sided luggage of claim 1, further comprising a flap externally attached to said lid and configured to extend across the first zipper track and securely couple to said compartment through a coupling member, when the lid is zipped to the compartment.

4. The soft-sided luggage of claim 3, wherein said coupling member is a staple externally attached to said compartment and configured to fit through an aperture on said flap.

5. The soft-sided luggage of claim 4, further comprising a padlock shackled through the staple such that the flap is locked to the compartment.

6. The soft-sided luggage of claim 1, further comprising a second rigid barrier internally attached to the compartment's pliable side walls positioned alongside and extending to at least the substantial length of the first zipper track, and configured such that it extends into the lid, past the second zipper track, when said lid is closed on said compartment.

7. The soft-sided luggage of claim 6, further comprising a flap externally attached to said lid and configured to extend across the first zipper track and securely couple to said compartment through a coupling member when the lid is zipped to the compartment.

8. The soft-sided luggage of claim 7, wherein said coupling member is a staple externally attached to said compartment and configured to fit through an aperture on said flap.

9. The soft-sided luggage of claim 8, further comprising a padlock shackled through the staple such that the flap is locked to the compartment.

10. The soft-sided luggage of claim 7, further comprising a plurality of pull tabs positioned on said first and second zipper tracks and configured to be locked by a padlock.

11. Soft-sided luggage comprising:

a compartment having pliable side walls surrounding a bottom panel and defining an open cavity;

a first zipper track attached to a plurality of said compartment side walls;

a lid having pliable side walls surrounding a top panel, wherein said lid is configured to fit on said compartment such that said cavity is closed;

a second zipper track attached to a plurality of said lid side walls and configured to releasably interlock with the first zipper track; and a first rigid barrier internally attached to the compartment's pliable side walls, positioned alongside and extending to at least the substantial length of the first zipper track, and configured such that it extends into the lid, past the second zipper track, when said lid is closed on said compartment.

12. Soft-sided luggage comprising:

a bag having first and second sides defining a compartment;

a first zipper track attached to said first side;

a second zipper track attached to said second side and configured to releasably interlock with the first zipper track such that both said first and second sides close said compartment; and a first rigid barrier internally attached to the first side of the compartment, positioned alongside and extending to at least the substantial length of the first zipper track, and configured such that it extends across said second zipper track into the second side of the compartment, when the first and second sides are zipped together.

13. The soft-sided luggage of claim 12, further comprising a plurality of pull tabs positioned on said first and second zipper tracks and configured to be locked by a padlock.

14. The soft-sided luggage of claim 12, further comprising a flap externally attached to the first side and configured to extend across the second zipper track and securely couple to said second side, through an external coupling member, when the first and second sides are zipped together.

15. The soft-sided luggage of claim 12, further comprising a second rigid barrier internally attached to the second side, positioned alongside and extending to at least the substantial length of the second zipper track, and configured such that it extends into the first side, past the first zipper track, when said first and second sides are zipped together.

* * * * *